US005890126A

United States Patent [19]

Lindemann

[11] Patent Number: 5,890,126

[45] Date of Patent: Mar. 30, 1999

[54] AUDIO DATA DECOMPRESSION AND INTERPOLATION APPARATUS AND METHOD

[75] Inventor: Eric Lindemann, Boulder, Colo.

[73] Assignee: EuPhonics, Incorporated, Boulder, Colo.

[21] Appl. No.: 815,318

[22] Filed: Mar. 10, 1997

[51] Int. Cl.[6] ..... G10L 7/06

[52] U.S. Cl. ..... 704/503; 704/265; 84/603; 375/240; 375/241; 379/93.08

[58] Field of Search ..... 704/503, 265, 704/217, 220, 203, 207, 226, 227; 84/603; 375/240, 241; 379/93.08; 364/723

[56] References Cited

U.S. PATENT DOCUMENTS

| | | | |
|---|---|---|---|
| 4,058,676 | 11/1977 | Wilkes et al. | 704/220 |
| 4,546,342 | 10/1985 | Weaver et al. | 341/51 |
| 4,631,746 | 12/1986 | Bergeron et al. | 704/217 |
| 4,754,483 | 6/1988 | Weaver et al. | 704/203 |
| 5,054,072 | 10/1991 | McAulay et al. | 704/207 |
| 5,111,727 | 5/1992 | Rossum | 84/603 |
| 5,341,457 | 8/1994 | Hall, II et al. | 704/226 |
| 5,526,353 | 6/1996 | Henley et al. | 370/392 |

*Primary Examiner*—David R. Hudspeth
*Assistant Examiner*—Vijay B. Chawan
*Attorney, Agent, or Firm*—Jennifer L. Bales; Macheledt Bales & Johnson LLP

[57] ABSTRACT

Apparatus for simultaneously decompressing and interpolating compressed audio data. The compressed audio data is stored in differential log format, meaning that the difference between each two consecutive data points is taken and the log of the difference calculated to form each compressed data point. To efficiently decompress and interpolate the compressed data, advantage is taken of the fact that addition of logs is equivalent to multiplication of linear values. Thus the log of an interpolation factor is added to each compressed data point prior to taking the inverse log of the sum. An integrator block completes the interpolation and decompression of the data.

19 Claims, 8 Drawing Sheets

AUDIO DATA DECOMPRESSION AND INTERPOLATION APPARATUS AND METHOD

BACKGROUND OF THE INVENTION

1. Field of the Invention

The present invention relates to apparatus and methods for decompressing and interpolating audio data.

2. Description of the Prior Art

Audio data is frequently compressed before it is stored in order to save data storage space. For example, the difference between consecutive data points may be taken and the difference (a smaller number requiring less bits) may be stored. Many other compression methods are known in the art.

In a digital system such as a computer or a music synthesizer, sound data is stored in tables, from which it is read out and converted to analog format before being played. Sets of data are stored for a variety of different pitches. If the pitch of a desired note does not correspond exactly to the pitch of one of the stored notes, a technique called "interpolation" is used to shift the pitch. In an analogsystem such as a tape recorder, it is easy to change the pitch of sound by playing the tape slower or faster (munchkinizing the data). But in a digital system, data points are stored only at set intervals, and the data is read out at a fixed rate. To "play the data faster," points of data which fall between the stored points must be calculated. To play the note at a pitch 25% higher than the stored pitch, data points are calculated at 2.25, 3.5, 4.75, etc. Then these points are read out at the original fixed data rate, which gets through the data quicker, and results in a higher pitched sound, just like playing a tape faster would. The interpolation used to compute these in between points may be linear interpolation or higher order interpolation.

Decompressing the stored audio data, followed by interpolation to change the pitch of the data, requires many computational steps. A need remains in the art for apparatus and methods for more efficiently decompressing and interpolating audio data.

SUMMARY OF THE INVENTION

An object of the present invention is to provide apparatus and methods for more efficiently decompressing and interpolating audio data. It is an object of the present invention to combine the decompression operation and the interpolation operation in a design which is more efficient than current designs which keep these operations separate.

Apparatus for simultaneously decompressing and interpolating a stream of audio data points having differential log format to form a series of decompressed and interpolated output data points comprises means for providing a stream of differential log format compressed data points, means for calculating a quantity equivalent to an audio data point before compression for each desired output data point, means for generating an interpolation term for each desired output data point, means for summing the quantity and the interpolation term to form each desired interpolated and decompressed output data point, and means for sequentially outputting each interpolated and decompressed output data point.

In order to accomplish linear interpolation simultaneously with decompression, the means for providing a stream of differential log format compressed data points provides data points having the format log (x(n+1)−x(n)), where x(n) and x(n+1) are consecutive data points before compression. The calculating means calculates quantities equivalent to x(n), and the generating means generates interpolation terms of the form $\alpha$(x(n+1)−x(n)), where $\alpha$ is the desired fractional distance to accomplish interpolation between data points x(n) and x(n+1).

The calculating means includes an antilog block through which compressed data points log (x(n−m)−x(n−m−1)) through log (x(n)−x(n−1)) are passed, to get x(n−m)−x(n−m−1) through x(n)−x(n−1). An initial condition term equivalent to x(n−m−1) is summed with x(n−m)−x(n−m−1) through x(n)−x(n−1), to form a quantity equivalent to x(n).

The generating means includes means for providing the term log $\alpha$, and summing the term log $\alpha$ with the compressed data point log (x(n+1)−x(n)) to get log $\alpha$+log (x(n+1)−x(n))=log ($\alpha$(x(n+1)−x(n))). This term is passed through the antilog block to get $\alpha$(x(n+1)−x(n)).

This apparatus may be modified to apply a gain by providing terms equivalent to log (gain) and adding the log (gain) term to log (x(n−m)−x(n−m−1)) through log (x(n)−x(n−1)), and also adding the log (gain) term to the log $\alpha$+log (x(n+1)−x(n)) term.

In order to accomplish polyphase interpolation simultaneously with decompression, the providing means provides data points having the format log (x(n+1)−x(n)), where x(n) and x(n+1) are consecutive data points before compression. The calculating means calculates quantities equivalent to x(n). The generating means generates interpolation terms of the form $C_1$ (x(n+1)−x(n))+$C_2$(x(n+2)−x(n+1))+ . . . +$C_{N-1}$*(x(n+N−1)−x(n+N−2)), where $C_1$ through $C_{N-1}$ are coefficients previously derived from $\alpha$, the desired fractional distance to accomplish interpolation between data points x(n) and x(n+1), said coefficients selected to accomplish polyphase interpolation of order N.

The calculating means includes an antilog block through which is passed compressed data points log (x(n−m)−x(n−m−1)) through log (x(n)−x(n−1)) to get x(n−m)−x(n−m−1) through x(n)−x(n−1). An initial condition term equivalent to x(n−m−1) is summed with x(n−m)−x(n−m−1) through x(n) −x(n−1), to form a quantity equivalent to x(n).

The generating means includes means for providing the terms log (C1) through log ($C_N$−1). The terms log ($C_1$) through log ($C_{N-1}$) are sequentially summed with sequential compressed data points log (x(p+1)−x(p)) through log (x(p+N−1)−x(p+N−2)) to get log ($C_1$)*log (x(p+1)−x(p)) through log ($C_{N-1}$)*log (x(p+N−1)−x(p+N−2))=log ($C_1$*(x(p+1)−x(p))) through log ($C_{N-1}$*(x(p+N−1)−x(p+N−2)). log ($C_1$*(x(p+1)−x(p))) through log ($C_{N-1}$*(x(p+N−1)−x(p+N−2)) are passed through the antilog block to get ($C_1$*(x(p+1)−x(p)) through ($C_{N-1}$*(X(p+N−1)−x(p+N−2).

This apparatus may be modified to apply a gain by providing terms equivalent to log (gain) and adding the log (gain) term to log (x(n−m)−x(n−m−1)) through log (x(n)−x(n−1)), and also adding the log (gain) term to the log (x(p+1)−x(p)) through log (x(p+N−1)−x(p+N−2)) terms.

DETAILED DESCRIPTION OF THE PREFERRED EMBODIMENT

Figure 1:
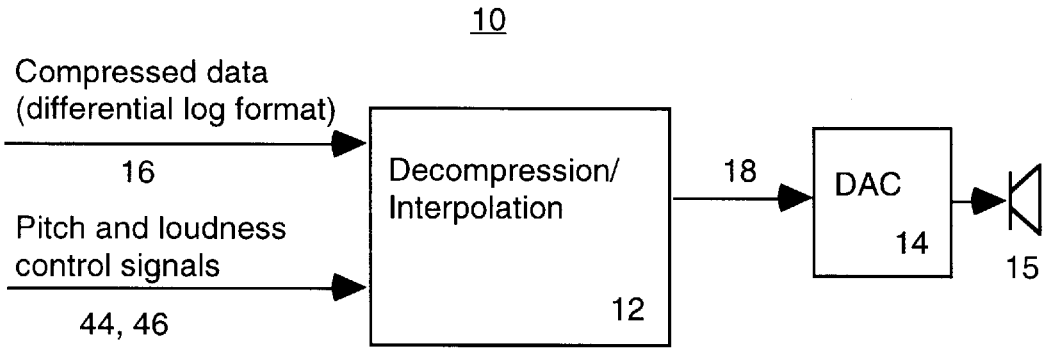
FIG. 1 shows a decompression/interpolation device according to the present invention.

FIG. 1 shows a decompression/interpolation device 12 according to the present invention. Decompression/interpolation device 12 has as its inputs compressed audio data 16 and pitch and loudness controls 44, 46. Compressed audio data 16 has previously been formatted into differential log format, as follows. The difference between two consecutive data points is calculated, and the log of this difference is taken. Thus each stored data point has the structure:

$\log(x(n+1)-x(n))$, where x(n) and x(n+1) are consecutive data points.

One purpose of utilizing the differential log format for the stored data is to save storage space. The difference between adjacent samples for most sounds results in a signal with lower variance than the original signal. This lower variance signal can be coded with fewer bits than the original signal. In addition, when the logarithm of the differences is stored, rather than the differences themselves, this results, in the case of audio signals, in a more efficient use of bits. The result is that storing, for example, an 8 bit log of the differences of adjacent samples gives a signal to noise ratio close that of a 16 bit linear coding scheme for many realistic sounds.

Figure 2:
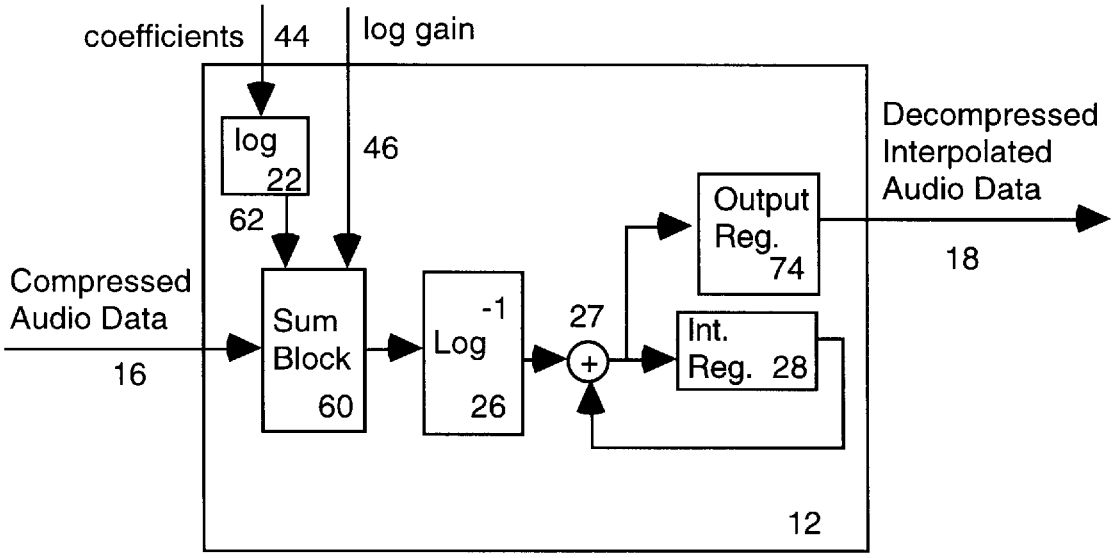
FIG. 2 shows the decompression/interpolation device of FIG. 1 in more detail.
Figure 3:
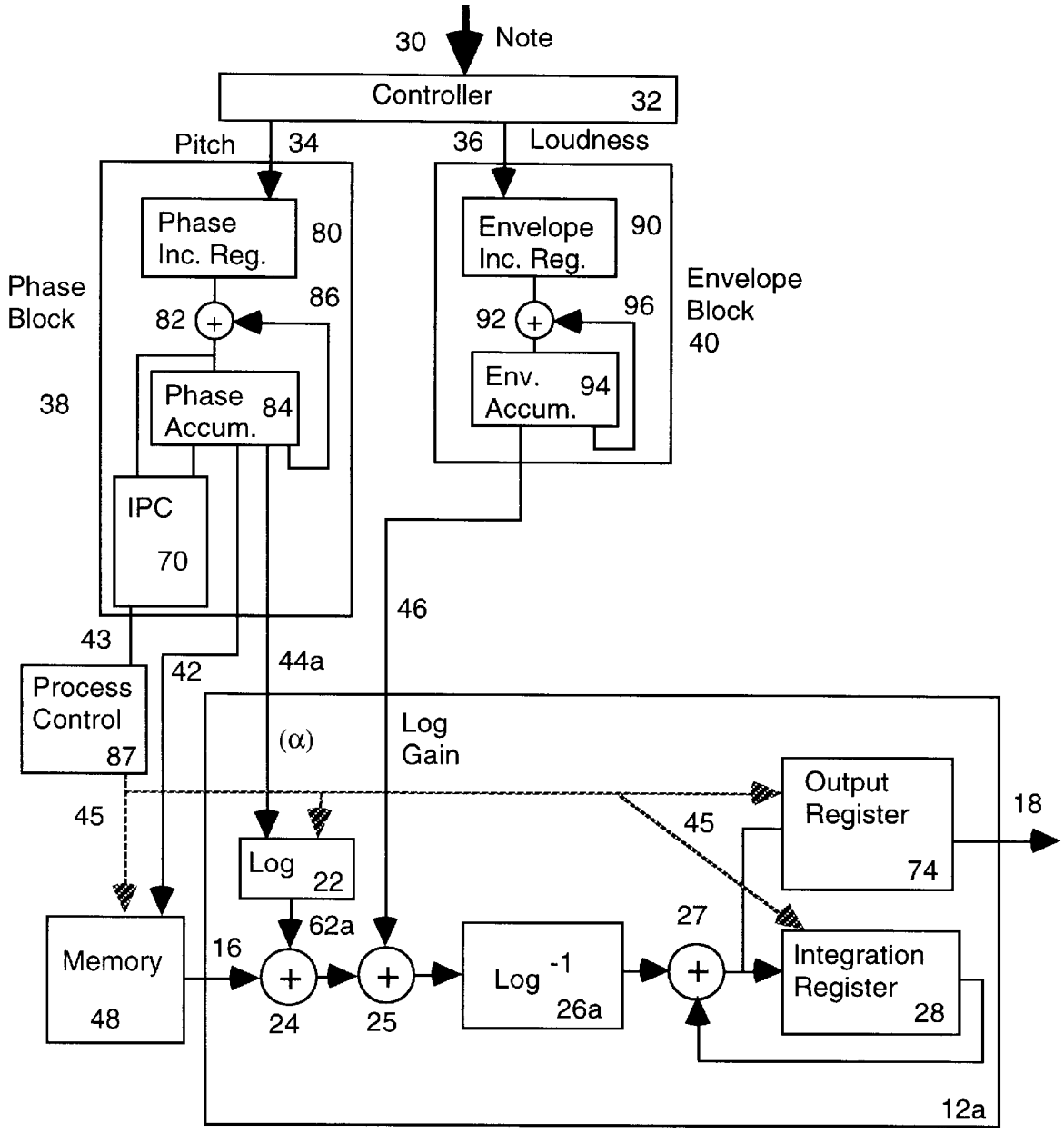
FIG. 3 shows a first embodiment of the decompression/interpolation device of FIG. 1, utilizing a linear interpolation scheme.
Figure 4:
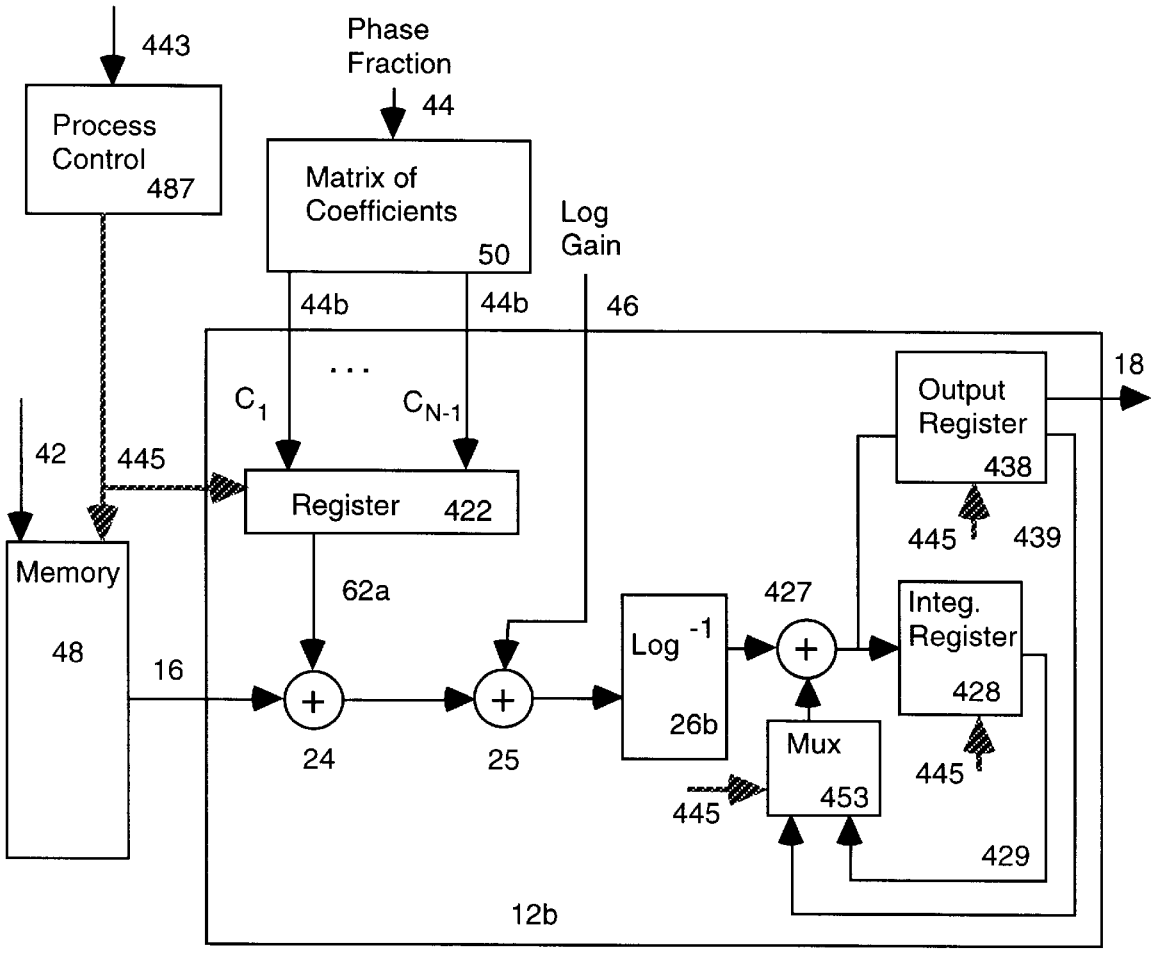
FIG. 4 shows a second embodiment of a decompression/interpolation device of FIG. 1, utilizing a higher order interpolation scheme.

In addition, the log format is useful during the interpolation phase. The present invention takes advantage of the fact that adding the log of two quantities is equivalent to the log of the product of the two quantities. Thus, the log of a gain which is to be applied to the signal may be added to each compressed data point prior to taking the inverse log, rather than multiplying each decompressed data point by the gain value. More importantly, interpolation involves multiplies which are expensive to implement in hardware. These multiplies can be replaced with addition of logarithms thanks to the log compression format. Addition is a much less expensive operation to implement in hardware. Since the final output must be linear, and since the interpolation operation also involves linear additions, it is necessary to convert from log to linear format. This is easily accomplished with a small lookup table, thanks to the reduced (e.g. 8 bit) representation of the log format. FIGS. 2–4 show these operations in detail.

Pitch and loudness control signals 44, 46 are utilized by decompression/interpolation device 12 to determine the gain and interpolation coefficients to be applied to the compressed data 16. These computations are shown in FIGS. 3 and 4.

Output signal 18 is provided to a digital to analog converter (DAC) 14. The analog signal is provided to a speaker 15. An amplifier (not shown) may be incorporated between DAC 14 and speaker 15.

FIG. 2 shows decompression/interpolation device 12 of FIG. 1 in more detail. Decompression/interpolation device 12 has been divided into three main functional blocks, a sum block 60, an inverse log block 26 and an integrator comprising adder 27 and integration register 28. In addition, block 22 computes the log 62 of coefficients 44. Gain is provided in log format via signal 46. Output register 74 stores and clocks out output data point 18 at appropriate times. Two possible implementations of these blocks are shown in FIGS. 3 and 4. Those skilled in the art will appreciate that other implementations according to the present invention are possible as well.

For linear interpolation, output data points 18 have the following form, ignoring gain:

$x(n)+\alpha(x(n+1)-x(n))$, where $\alpha$ is a fractional coefficient used to implement interpolation.

Integration register 28 is used to generate the x(n) term. x(0) is stored as an initial condition in register 28, and n compressed audio data points are antilogged and added to x(0) to form x(n). Then, the next compressed data point, log ((x(n+1)−x(n)) is added to log $\alpha$, provided as signal 62, in sum block 60, antilogged by block 26, added to the term stored in integration register 28 by adder 27, and stored in output register 74. If gain is applied, it is added to each compressed data point 16. The linear interpolation case is shown in more detail in FIG. 3.

For the case of higher order interpolation, a set of coefficients is provided as signal 44. After the x(n) term is formed in integration register 28, sum block 60 sequentially adds compressed audio data points 16 with log coefficients 62 and, optionally, log gain 46. Since compressed data 16 is in differential log format, the addition of these three log format quantities is equivalent to multiplying the linear quantities and taking the log of the result. The output of inverse log block 26 is then the three linear quantities (gain, coefficients, and differential format data) multiplied together. Thus the compressed data has been scaled by gain 46 and by coefficients 44. The coefficients systematically scale the stream of differential format data points to implement higher order interpolation. Adder 27 adds the x(n) term to the first coefficient scaled term and stores the result in output register 74. The additional coefficient scaled terms are added to output register 74 and the results output by output register 74 as output signal 18. Thus, the output data points have the form:

$$g^*x(n)+C_1{}^*g^*(x(n+1)-x(n))+C_2{}^*g^*(x(n+2)-x(n+1))+\ldots+C_{N-1}{}^*g^*(x(n+N-1)-x(n+N-2))$$

The higher order interpolation case is shown in more detail in FIG. 4.

FIG. 3 shows one preferred embodiment, 12*a*, of decompression/interpolation device 12 of FIGS. 1 and 2, which incorporates linear interpolation. Desired note 30 is provided to controller 32, for example from a keyboard or from a CD-ROM. Desired note 30 includes such information as pitch and loudness. Controller 32 provides a signal 34 representing note pitch to phase accumulation block 38. In the preferred embodiment, signal 34 comprises a value representing phase increment. Controller 32 may dynamically change this value, for example to achieve a vibrato effect. Phase increment is the change in address in memory 48 from the last data point 34. Memory 48 stores sets of data representing notes at a variety of different pitches. There is a starting address in sound table memory 48 corresponding to a particular recorded sound (e.g. a particular pitch). The present invention increments through memory 48 at a rate determined by the phase increment.

Phase increment register 80 stores the current phase increment. Phase accumulator 84 adds the current phase (or address in memory 48) to the current phase increment (or change in address) from block 80 to get the next phase (next address). The integer part of the current phase 42 is not strictly required, but is useful in indicating the ending address in memory. The fractional part of the current phase (or α) 44 is provided to decompression/interpolation device 12*a*, which will use signal 44 to accomplish interpolation. The output of adder 82 and the output of phase accumulator 84 are also provided to integer phase counter (IPC) 70 which subtracts the integer portion of the two values and outputs the result as count signal 43. Process control block 87 uses signal 43 to control the operation of other blocks in the system via control signals 45, as described below.

Controller 32 also provides a signal 36 representing loudness to envelope generator 40. In the preferred embodiment, signal 36 comprises log envelope increment, which is the log of the change in the gain envelope to be applied to the audio signal. The log gain value 46 will be needed by decompression/interpolation device 12*a*. In addition, it is more efficient to use log values for audio signals, because of how the human ear is constructed. As an alternative, signal 36 could comprise the linear envelope increment, the operations in envelope block 40 could be performed linearly, and a log operation could be applied to the output of envelope block 40.

In the embodiment of FIG. 3, signal 36 comprises a series of data points representing log envelope increment. Envelope increment is the change in gain from the last data point 36. Envelope increment register 90 stores the current log envelope increment. Envelope accumulator block 44 adds the current log envelope value to the current log envelope increment from block 90 to get the next log gain 46. Log gain 46 is applied to the compressed memory data by decompression/interpolation device 12*a*.

Compressed data sets representing notes at a variety of different pitches are stored in memory 48. Generally the phase increment register 80 contains a value with an integer and fractional part. The phase increment value corresponds to the rate at which data will be read out of memory. This in turn corresponds to the pitch of the output signal. When the phase increment register 80 is added to the value in phase accumulator 84, a current phase is generated which also has an integer and fractional part. The phase accumulator value can be thought of as an integer plus fractional address in memory 48. Memory 48 contains only values at integer addresses. In the present invention, it contains only log difference values at integer addresses. It is the purpose of the interpolation circuit to generate a value which lies a fractional distance between two values of the original sample stream. This is done by forming a linear combination of integer address values on either side of the desired integer plus fractional address in memory 48.

The embodiment shown in FIG. 3 accomplishes interpolation simply and elegantly by taking advantage of the format of the compressed data to accomplish linear interpolation concurrently with decompressing the data.

It is important to emphasize the synergy of combining interpolation with decompression, as is done in the present invention. A first order linear interpolator calculates an interpolated output sample using the formula:

$$y(n+1)=(1-\alpha)x(n)+\alpha x(n+1)=x(n)+\alpha(x(n+1)-x(n))=x(n)+\text{antilog}\ (\log(\alpha)+\log(x(n+1)-x(n)))$$

where α is the fractional part 44*a* of the phase accumulator value and y(n+1) is an interpolated value lying a fractional distance a between previously sampled data values x(n) and x(n+1).

The term log (x(n+1)−x(n)) is already available, because it is of the same form as the differential log compression format. The multiplication of the x(n+1)−x(n) term by α is accomplished by adding the stored compressed value log ( x(n+1)−x(n)) to the log of α. The conversion from phase fraction to log (α) is accomplished by lookup table 22. The antilog of the term log (α) +log (x(n+1)−x(n)) is taken to convert to the linear value α(x(n+1)−x(n)). This is done with lookup table 26*a*.

The linear term α(x(n+1)−x(n)) is then added to a previously calculated x(n) to form the interpolated output y(n+1). Since the compressed log difference format uses (for example) 8 bit values, the addition in the log domain is accomplished with 8 bit adders. A small lookup table is used to convert from 8 bit log difference format to 16 bit linear difference format. By taking advantage of the log difference compression format, an expensive 16 bit linear multiplier has been replaced by an extremely inexpensive 8 bit adder and a small 256*16 lookup table. Not only are multiplies replaced with adds, but the adders can be small and inexpensive because of the small size of the compressed data words. This demonstrates the synergy of the present invention: the differencing operation serves both to allow storage of small words (for data compression) and also greatly simplifies the interpolation circuitry.

In the equation above, the term α(x(n+1)−x(n)) is added to a previously computed value x(n). The term x(n) corresponds to one of the original sampled signal values before differencing. To understand how x(n) is generated, the step by step operation of the decompression and interpolation circuit is now described in greater detail.

The circuit is initialized by loading the Phase Accumulator Register (PAR) 84, the Phase Increment Register (PIR) 80, the Envelope Accumulator Register (EAR) 94, the Envelope Increment Register (EIR) 90, and the Integration Register (IR) 28 with starting values. It may be advisable to modify these initial conditions at key transition points. IR 28 is loaded with the first linear sample of the desired signal, x(0), times the initial linear gain value, g(0). This is also taken as the first output of the system:

y(0)=x(0)*g(0)

The EAR 94 is loaded with log g(0). The EIR 90 is loaded with a log envelope increment value which will be repeatedly added to the initial log gain to generate a time varying gain. In the preferred embodiment, the envelope accumulation is done in the log domain which results in perceptually desirable changes in gain envelope. The use of log adds to replace linear multiplies means that log gain values can be used directly, which is another example of synergy in the system. The EIR 90 may be periodically updated by external signal 36 to change the rate and direction of change of the gain envelope. PAR 84 is loaded with the address of log (x(1)−x(0)), the first log difference sample stored in memory 48. Assume this is at address zero. PIR 80 is loaded with an increment determined by the ratio of the desired pitch to the originally sampled pitch. Assume that PIR is loaded with 1.25.

The system output 18 is taken from the input to IR 28. The first sample to be calculated is y(1) which is the sample at fraction address 0+1.25=1.25. This is a sample at fractional distance 0.25 between x(1) and x(2). The interpolated sample is:

y(1)=gain*x(1)+gain*0.25*(x(2)−x(1))

To generate this value, x(1) must first be generated. This is calculated as:

gain*x(1)=gain*x(0)+gain*(x(1)−x(0))

The term (x(1)−x(0)) is the antilog of the first log difference sample stored in memory 48. This is read out and added to log gain 46. Log (α) 62*a* is forced to zero by control signal 45 during this step so that α has no effect on this difference term. Log (gain)+log (x(1)−x(0)) is passed through the antilog lookup table 26*a* and added to value gain*x(0) previously stored in IR 28. The result is stored in IR 28 as gain*x(1). The next log difference value log (x(2)−x(1)) is read from memory. This time log α=log (0.25) is added to log (x(2)−x(1)) and then added to log (gain). The resulting sum is passed through antilog table 26*a* to generate the linear term gain*0.25*(x(2)−x(1)) which is added to gain*x(1) currently in IR 28. The resulting sum is the interpolated output y(1) which is latched into output register (OR) 74. This sum is not loaded into IR 28, which currently holds gain*x(1). This load is prevented by control signal 45. Instead, log (α) is once again forced to zero so that log (gain)+log (x(2)−x(1)) passes through the antilog table and is added to IR 28 so that the value in IR 28 now is equal to:

$$\text{gain}*x(2)=\text{gain}*x(1)+\text{gain}(x(2)-x(1))$$

This term is needed to generate the next output sample, y(2), which is at fractional address 2.5, and will be generated by interpolation just as y(1) was generated. In general, the process of linear interpolation involves reading an integer number of log difference samples from memory 48, adding these to gain, and adding the antilog of this logsum to IR 28. At this point IR 28 contains x(n), where x(n) corresponds to the integer sample immediately preceding the desired fractionally interpolated output y(n). Then the next log difference sample log (x(n+1)−x(n) is read from memory 48 and added to log (α) plus log (gain) and the antilog of this term is added to the current value in IR 28 and the sum loaded into the output register. Then the process repeats.

The number of values added to IR 28 in between each output sample calculation corresponds count 43, the difference between the integer part of the current PAR 84 value and the integer part of the next PAR 84 value. Count signal 43 is determined by Integer Phase Counter (IPC) 70, and used by phase control block 87 to generate control signals 45, which control the number of reads of memory 48 and clock enables of the integration register 28 and the output register 28, as well as forcing the output 62*a* of log block 22 to zero at appropriate times. During clocking of IR 28, log (α) is always forced to zero.

When the count is zero the next interpolated output is generated by reenabling log (α) and clocking the output register.

A specific example is given here to assist with understanding the apparatus of FIG. 3. In this example, phase increment 34=2.37. Walking through three phase increments illustrates the operation of FIG. 3. In this example, phase increment is a constant 2.37. Those skilled in the art will appreciate that the phase increment may also change with time, if pitch is not constant. Gain is ignored in this example for simplicity.

TABLE 1 illustrates the computation of count signal 43, phase integer 42, and phase fraction (α) 44*a*, for the example where phase increment 34=2.37. PAR 84 was initialized to 0, assumed in this case to be the address of the first data point, x(1)−x(0). Count signal 43 is the integer portion of the value out of adder 82 minus the integer portion of the value in PAR 84. Count 43 is used by process control 87 to determine how many values to sum in IR 28 before calculating an output value 18. The value out of 82 is 2.37−0=2.37, while the value in PAR is still 0. Thus value 43 for the first increment is 2−0=2.

Then, the value out of adder 82, 2.37, is stored in PAR 84. The integer portion 42 of the PAR value is 2, and the fraction portion 44*a* is 0.37.

After the second increment 34 is provided to phase block 38, the value out of 82 is 4.74, and the value in PAR 84 is still 2.37, resulting in a count 43 of 4−2=2. After the value from adder 82 is loaded into PAR 84, integer address 42 is 4 and fraction address 44*a* is 0.74.

After the third increment 34 is provided to phase block 38, the value out of 82 is 7.11, and the value in PAR 84 is still 4.74, resulting in a count 43 of 7−4=3. After the value from adder 82 is loaded into PAR 84, integer address 42 is 7 and fraction address 44*a* is 0.11.

TABLE 1

| | PIR 80 | PAR 84 | adder 82 | count 43 | 42 | α 44a |
|---|---|---|---|---|---|---|
| 1st increment | 2.37 | 0 | 2.37 | 2 | — | — |
| | 2.37 | 2.37 | — | — | — | — |
| | 2.37 | 2.37 | — | — | 2 | 0.37 |
| 2nd increment | 2.37 | 2.37 | 4.74 | 2 | — | — |
| | 2.37 | 4.74 | — | — | — | — |
| | 2.37 | 4.74 | — | — | 4 | 0.74 |
| 3rd increment | 2.37 | 4.74 | 7.11 | 3 | — | — |
| | 2.37 | 7.11 | — | — | — | — |
| | 2.37 | 7.11 | — | — | 7 | 0.11 |

TABLE 2 illustrates how the embodiment of FIG. 3 operates for the present example. Gain is ignored for the moment, but is discussed below. The leftmost column provides times from 0 to 23 for convenience in discussing the table, but these times are even increments or clock counts. In some cases, two operations shown at separate times could be performed at the same time.

At time 0, value x(0) has been preloaded as an initial condition into integration register 28. For the first phase increment, count 43 was 2 (see table 1 above), so two compressed values from memory 48 will be combined with initial condition in IR 28 before the first output value is computed. At time 1, the first compressed data point, log (x(1)−x(0)), is available as signal 16. Signal 62*a* is held at zero. Block 26*a* takes the inverse log of the first compressed data point to get x(1)−x(0), which is combined with the initial value in IR 28 resulting in the value x(1) being stored back into IR 28 at time 2. At time 3 the next compressed data point log (x(2)−x(1)) is available as signal 16. The inverse log of this value is combined with the value in IR 28 to form x(2), which is stored in IR 28 at time 4. Since two compressed data points have been combined in IR 28, it is now time to compute the first output data point.

The value log (x(3)−x(2)) comes in as signal 16. Signal 62*a* is allowed to go to log (α), and adder 27 combines the inverse log of these values with the contents of IR 28 to form x(2)+α(x(3)−x(2)), which is stored in output register 74 at time 6. At time 7, this value is clocked out as signal 18. In this example, the first a is 0.37.

The steps performed at times 8–14 are nearly identical to those performed at times 1–7. Signal 62*a* is held at zero while the current compressed data value, log (x(3)−x(2)), and the next compressed data value, log (x(4)−x(3)) are antilogged and combined in IR 28, to form x(4). Then log (x(5)−x(4)) is combined with log (α). The second α is 0.74, as shown in TABLE 1. This result is antilogged and combined with the contents of IR 28 and placed in OR 74, at time 13. At time 14 the contents of OR 74 are clocked out on signal 18.

The steps performed at times 9–23 are similar to the first two sets of steps, with one difference. For the third phase increment, count signal 43 is 3 rather than 2. Therefore, the antilogs of three compressed data values are combined with the contents of IR 28 before the output data point is computed. The output data point 18 in this case will be $x(7)+\alpha(x(8)-x(7))$, with $\alpha=0.11$.

TABLE 2

| | at 16 | at 62a | IR 28 | in OR 74 | Output 18 |
|---|---|---|---|---|---|
| 0 | — | 0 | x(0) | 0 | — |
| 1 | log(x(1) − x(0)) | 0 | x(0) | | — |
| 2 | — | 0 | x(1) | | — |
| 3 | log(x(2) − x(1)) | 0 | x(1) | | — |
| 4 | — | 0 | x(2) | | — |
| 5 | log(x(3) − x(2)) | log(α) | x(2) | | — |
| 6 | — | 0 | x(2) | x(2) + α(x(3) − x(2)) | — |
| 7 | — | 0 | x(2) | | x(2) + α(x(3) − x(2)) |
| 8 | log(x(3) − x(2)) | 0 | x(2) | | — |
| 9 | — | 0 | x(3) | | — |
| 10 | log(x(4) − x(3)) | 0 | x(3) | | — |
| 11 | — | 0 | x(4) | | — |
| 12 | log(x(5) − x(4)) | log(α) | x(4) | | — |
| 13 | — | 0 | x(4) | x(4) + α(x(5) − x(4)) | — |
| 14 | — | 0 | x(4) | | x(4) + α(x(5) − x(4)) |
| 15 | log(x(5) − x(4)) | 0 | x(4) | | — |
| 16 | | 0 | x(5) | | — |
| 17 | log(x(6) − x(5)) | 0 | x(5) | | — |
| 18 | | 0 | x(6) | | — |
| 19 | log(x(7) − x(6)) | 0 | x(6) | | — |
| 20 | | 0 | x(7) | | — |
| 21 | log(x(8) − x(7)) | log(α) | x(7) | | — |
| 22 | | | x(7) | x(7) + α(x(8) − x(7)) | — |
| 23 | | | x(7) | | x(7) + α(x(8) − x(7)) |

Gain was ignored in the above example. Assuming a constant gain, g, each term output as signal 18 is scaled by g to give terms of the form $g*x(n)+g*\alpha(n+1)-x(n))$. In the more general case where gain is not constant, there is a small residual term. This residual is normally not significant for relatively slowly changing signals. The residual appears because the accumulation occurring in IR does not result in perfect cancellation of terms when gain is changing. Thus, the first accumulation is:

$g(0)x(0)+g(1)\alpha(x(1)-x(0))=g(1)x(1)+x(0)(g(0)-g(1))$ if $g(0)=g(1)$, the x(0) term drops out. So long as g(0) is close to g(1), the residual term is negligible.

Linear interpolation is also called $2^{nd}$ order interpolation because it estimates a value a fractional distance between two values by linear combination of the 2 integer sample values, x(n) and x(n+1), surrounding the desired fractional sample. This linear combination involves two interpolation coefficients α and (1−α), where α is the fractional distance between x(n) and x(n+1). So the formula is:

$$y(n)=a(0)x(n)+a(1)x(n+1)$$

where:

$a(0)=\alpha$ $a(1)=(1-\alpha)$

Better fidelity can be achieved by using higher order interpolators. These involve linear combinations of larger numbers of consecutive input samples. For example a $4^{th}$ order interpolator generates a fractional sample output using:

$$y(n)=a(0)x(n-1)+a(1)x(n)+a(2)x(n+1)+a(3)x(n+2)$$

In this case the formula for generating the coefficients a(−1) through a(2) is still based on α but is more complicated. Since α generally changes for every output sample because of the addition of the integer+fractional phase increment to the phase accumulator, the coefficients a(m) also change for every output sample calculation. These coefficients turn out to be a selection of coefficients from an FIR low pass filter. This technique of changing coefficients is sometimes referred to a polyphase filtering and is well documented in the literature. See, for example, U.S. Pat. No. 5,111,727 by Rossum.

The fractional value a is expressed with a certain number of bits (e.g. 12 bits). The greater the number of bits of α the greater the pitch precision of the output signal. To select a set of filter coefficients based on α we extract some number of most significant bits of α and use these index into a table containing sets of coefficients. For example, if we extract the 8 most significant bits of α and use these to index into the table of coefficients then the table should contain 256 sets of coefficients. The coefficient table can be thought of as a matrix where each row represents a coefficient set and each column corresponds to a particular value of most significant bits of α. If we assume a $16^{th}$ order interpolator, 8 bits of α used for indexing, we have a 16*256 sized coefficient matrix.

Figure 6:
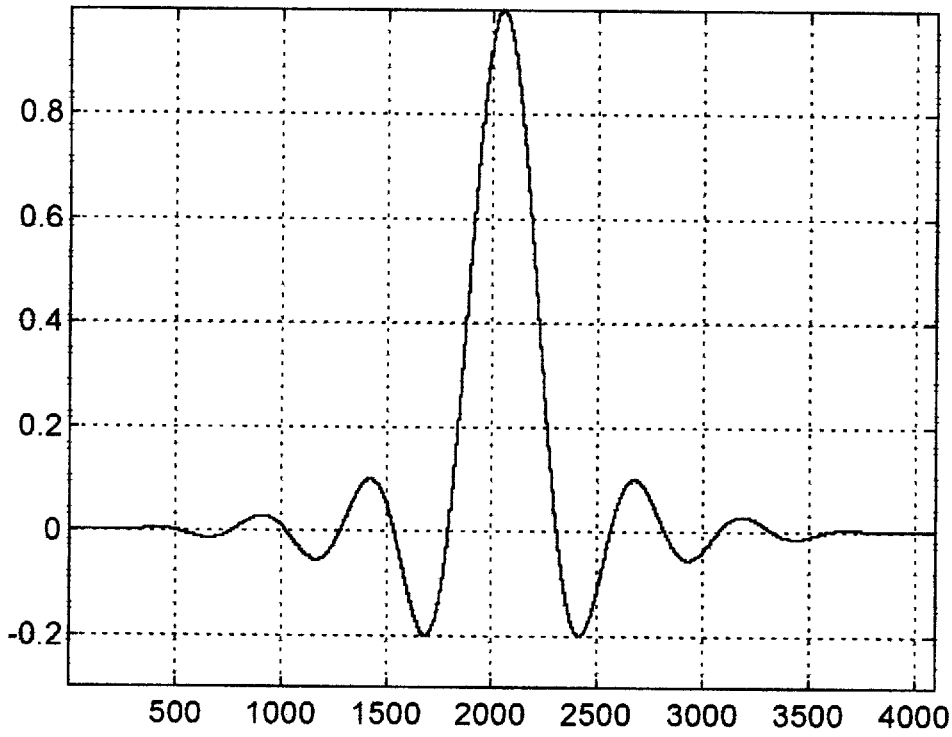
FIG. 6 is a plot of a sampled impulse response of a low pass filter used for higher order interpolation.
Figure 7:
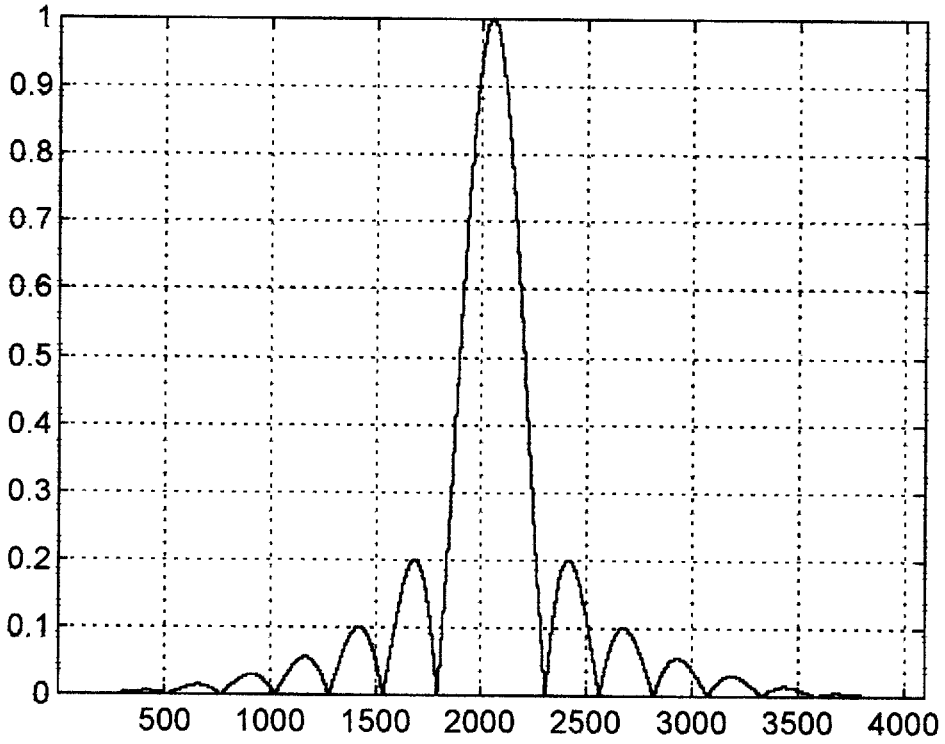
FIG. 7 is a plot of the absolute value of the impulse response of FIG. 6.

FIG. 6 shows a 4096 point sampled impulse response of a low pass filter used for interpolation. FIG. 7 shows the absolute value of the impulse response. The filter is designed by generating a sin (x)/x sync function and windowing it with a cosine squared Hanning window. This is a common FIR filter design technique. We divide the 4096 sample impulse response into 16 256 sample sections. Each section corresponds to one hump of the absolute value curve with the large center hump consisting of two 256 sample sections. Note that the first and last sections in the FIGS. 6 and 7 appear erroneously to be zero because of the limited graphic resolution of the plot. If we define each 256 sample section as the column of a 256*16 matrix then this defines a coefficient matrix suitable for interpolation. The most significant 8 bits of α are used to select a row of this matrix. Each row corresponds to a coefficient set. As a result, each coefficient set is 16 points long with one point taken from each 256 point section of the impulse response. The 8 bits of α select the offset into the 256 point sections with the same offset used for each section. As α changes for each output sample a new set of coefficients is selected from the matrix.

Just as we were able to make use of the log difference compression format for $2^{nd}$ order linear interpolation, we are also able to make use of it for higher order interpolation. The calculation of an interpolated output value involves forming the sum of products or dot product of a contiguous sequence or vector of input samples with a set of filter coefficients. Assume that for a particular output value the sequence of input samples is represented by:

[x(m), x(m+1), . . . x(m+N−1)]

and the set of coefficients by

[a(0),a(1), . . . a(N−1)]

We assume the output value to be calculated is a fractional distance between two of the input samples. For example the output y(n) corresponds to a sample a fractional distance between x(m+N/2) and x(m+N/2+1). The dot product operation for the calculation of y(n) is:

$$y(n)=a(0)x(m)+a(1)x(m+1)+\ldots+a(N-1)x(m+N-1)$$

Assume we have access to the difference values:

d(n)=x(n)−x(n−1) for all n

We can rewrite the dot product equation as:

$$y(n)=a(0)x(m)+a(1)x(m+1)+\ldots+(a(N-2)+a(N-1))x(m+N-2)+a(N-1)d(m+N-1)$$

where we have replaced the last x(m+N−1) term with d(m+N−1) and added the term a(N−1) to the coefficient of x(m+N−2) to compensate for this substitution. In other words we can replace the data input value of the last term of the dot product sequence with its corresponding difference value if we add the last coefficient to the coefficient of the second to last value in the sequence. If we now consider the N−2 length sequence consisting of the first N−2 terms of the dot product sequence modified by the substitutions described above then we can apply the same procedure giving:

$$\begin{aligned} y(n) = {} & a(0)x(m) + a(1)x(m+1) + \acute{E} + \\ & (a(N-3) + (N-2) + a(N-1))x(m+N-3) + \\ & (a(N-2) + a(N-1))d(m+N-2) + \\ & a(N-1)d(m+N-1) \end{aligned}$$

We can repeat the above substitution recursively to give the final sequence:

$$\begin{aligned} y(n) = {} & (a(0) + a(1) \ldots a(N-1))x(m) + \\ & (a(1) + a2) \ldots a(N-1))d(m+1) + \ldots + \\ & (a(2) + a(3) \ldots a(N-1))d(m+2) + \ldots + \\ & \cdot \\ & \cdot \\ & \cdot \\ & (a(N-2) + a(N-1))d(m+N-2) + \\ & a(N-1)d(m+N-1) \end{aligned}$$

We see that if we have access to the difference values, d(m+1) through d(m+N−1), and the first data term of the input sequence, x(m), we can calculate the Nth order interpolated output. We can simplify the equation above if we define:

$$c(0) = (a(0) + a(1) \ldots a(N-1))$$

$$c(1) = (a(1) + a2) \ldots a(N-1))$$

.
.
.

-continued $$c(N-2) = (a(N-2) + a(N-1))$$

$$c(N-1) = a(N-1)$$

Then we can rewrite the interpolation equation using difference values as:

$$y(n)=c(0)x(m)+c(1)d(m+1)+\ldots+c(N-1)d(m+N-1)$$

The coefficient c(0) consists of the sum of all coefficients a(0) . . . a(N−1) in the N length coefficient set. With appropriate design of the filter impulse response used to generate the filter coefficient matrix we will show that c(0) can be made equal to unity for all α. This property will be seen to be extremely useful in the embodiment described below.

Figure 8:
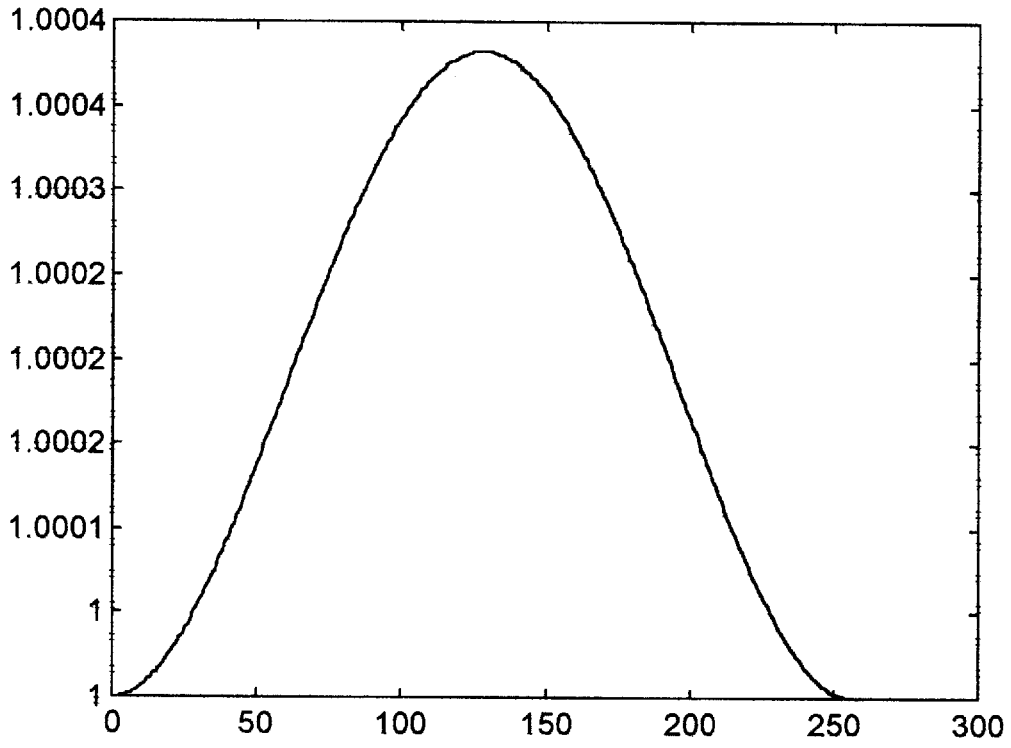
FIG. 8 is a plot of coefficients for the higher order interpolation case.

FIG. 8 shows a plot of c(0)=(a(0)+a(1)+ . . . +a(15)) for the 256 values of α described in the above example.

Figure 9:
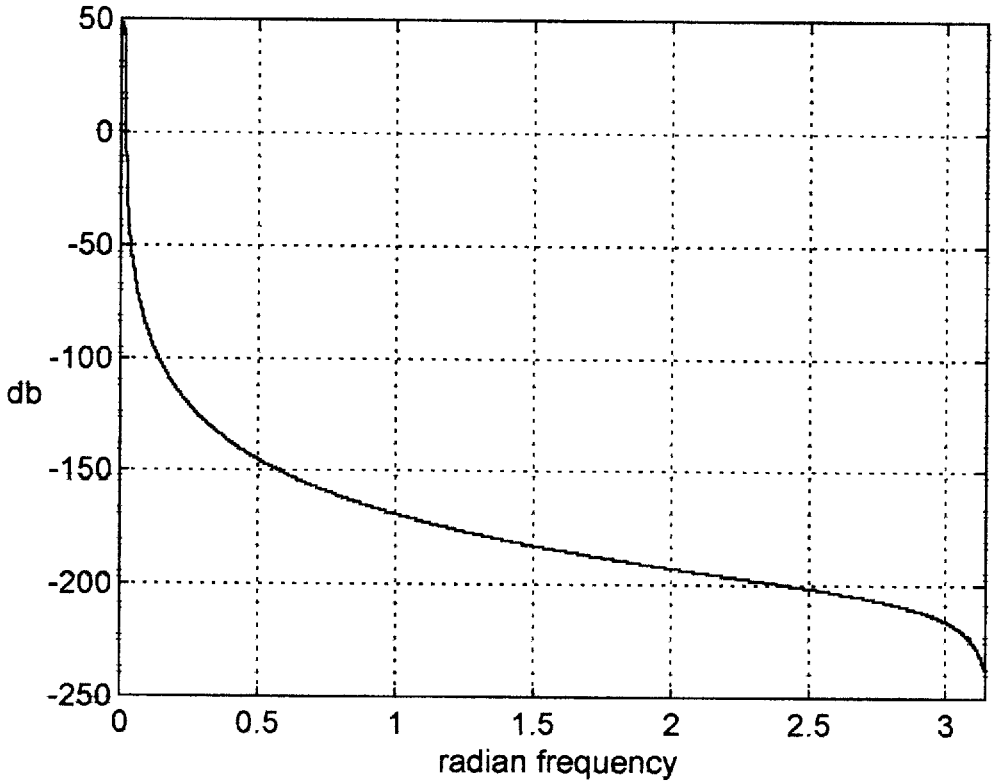
FIG. 9 is a plot of the dB magnitude frequency response of the filter utilizing the coefficients of FIG. 8, before and after simplifying modifications are applied.

We see that while the c(0) are close to 1 they are not exactly 1. If we divide each row of the coefficient matrix by the sum of elements in the row we guarantee that all c(0) will be exactly 1. We also modify the filter response slightly. FIG. 9 shows the dB magnitude frequency response of the filter before and after this modification has been applied. The smooth curve which is discernible at the region around radian frequency 2 and which is otherwise close to the top of the less smooth curve is the original unmodified response. After modification the less smooth curve results. This is still an excellent low pass filter, albeit with many zeros in its response, and will work well for interpolation.

When we implement this system we store a matrix of c(n) coefficient sets indexed by α rather then the a(n) coefficient sets described above. The c(0) coefficients are omitted since we have forced them to unity.

The $2^{nd}$ order interpolation equation using difference values, described earlier, is, in fact, a special case of the Nth order interpolator equation using difference values. The two original coefficients were a(0)=(1−α) and a(1)=α, giving:

$$\begin{aligned} y(n) &= a(0)x(m) + a(1)(x(m+1) \\ &= (a(0) + a(1))x(m) + a(1)(x(m+1) - x(m)) \\ &= (a(0) + a(1))x(m) + a(1)d(m) \\ &= c(0)x(m) + c(1)d(m) \\ &= x(m) + \alpha d(m) \end{aligned}$$

since:

c(0)=(1−α)+α=1 c(1)=a(1)=α

In the case of the $2^{nd}$ order interpolation circuit the generation of coefficients c(0), c(1) from α is trivial so no table is required. For all higher order interpolators a table of c(n) coefficients indexed by α is used.

FIG. 4 shows a higher order decompression/interpolation circuit 12*b* which is a generalization of the $2^{nd}$ order circuit of FIG. 3. As in the $2^{nd}$ order case, the circuit is initialized by loading the Phase Accumulator Register (PAR), the Phase Increment Register (PIR), the Envelope Accumulator Register (EAR), the Envelope Increment Register (EIR), the Integer Phase Count Register (IPC), and the Integration Register (IR) with starting values. The structure of phase block 38 and envelope block 40 are identical to FIG. 3, so these blocks are not shown in FIG. 4. Mux 453 has been added to integrator/decompressor 12*b*. Output Register 438 feeds back into Mux 453, as does IR 428. Mux 453 is at the input of adder 427 and selects either IR 428 or OR 438 as input to adder 427.

For higher order interpolation, a sampled difference signal stored in memory 448 always has the first N/2+1 samples (N=interpolation order) set to zero or, since log differences are used, the smallest possible value near zero. We call this value virtual zero.

When we compute interpolated outputs using an Nth order interpolator based on difference equations we calculate:

$$g(n)*y(n)=g(n)*(c(0)x(m)+c(1)d(m+1)+\ldots+c(N-1)d(m+N-1))$$

with c(0) always equal to 1, and g(n) is the nth gain value produced by the envelope accumulator. y(n) corresponds to the interpolated fractional address value $x(m+N/2-1+\alpha)$ where $\alpha$ is the fractional part of PAR.

IR 428 and OR 438 are initialed with g(0)*x(0+N/2−1+0)=y(0)=virtual 0, which is the first output. PAR (not shown) is initialized with 0+PIR (not shown). Assume PIR=1.25 as before, so PAR=1.25. The term "m" in the interpolation equation is equal to the integer part of PAR. The first interpolated output for N=16 and PIR=1.25 is therefore:

$$g(1)*y(1)=g(1)(x(1)+c(1)d(2)+\ldots+c(15)d(16))$$

where c(1) . . . c(N−1) are selected from the coefficient matrix at an index corresponding to $\alpha$=0.25 and EIR (not shown) has been added to EAR (not shown) to generate g(1). The output sample corresponds to x(1+N/2−1+0.25) which is a PIR=1.25 advance beyond y(0) as desired.

To calculate y(1) we must first calculate x(1). This is done by fetching a number of difference values from memory 448, taking their antilogs, and adding them to IR 428. The number of log differences to be fetched is determined by the count value 443, calculated, as in FIG. 3, by finding difference between the preceding and current PAR integer values (in this case is 1). Therefore compressed data value, corresponding to d(1), is fetched from memory 448, its antilog is taken and the linear value d(1) is added to IR 428 to form x(1)=x(0)+d(1). The value x(1) is also loaded into OR 438 at the same time. To generate the interpolated scaled output g(1)*y(1), the log difference values d(2), É, d(16) are then fetched in sequence from memory 448. Each is added to the corresponding log coefficient, log (c(1)) É log (c(15)) and to log (g(1)). The antilogs of these sums are formed and added to OR 438 to form g(1)*y(1). IR 428 remains fixed at x(1) in preparation for the next output calculation, which requires calculation of x(2). PAR is then incremented by PIR, IPC is updated and the process repeats to generate outputs y(2), y(3), y(4), É

Note that d(1) . . . d(16) have been fetched from memory 448 to generate y(1). To generate y(2), d(2) . . . d(17) will be used. Therefore fetching from memory 448 precedes in a several steps forward one large step back pattern.

Again a specific example will serve to illustrate the operation of the FIG. 4 embodiment. The fourth order case, where phase increment is again 2.37, will be shown. TABLE 1 is repeated here as TABLE 3 to show that count 43, phase integer 42, and phase fraction 44 are computed in the same manner as in the FIG. 3 linear interpolation example. Note that phase fraction 44 is not used directly, but is used to index into the matrix of coefficients 50. Three coefficients $C_1$, $C_2$, and $C_3$ are extracted from matrix 50 and provided to register 422 sequentially as signals 44*b*. Generally, signals 44*b* will actually comprise the logs of the coefficients, which have been stored in matrix 50. However, register 422 could also compute the logs of the coefficients if convenient. The logs of the coefficients will be sequentially combined with compressed data points from memory 448 and log gain 46 when it is time to compute the output data value 18.

TABLE 3

| | 80 | 84 | 82 | 43 | 42 | 44a |
|---|---|---|---|---|---|---|
| 1st increment | 2.37 | 0 | 2.37 | 2 | — | — |
| | 2.37 | 2.37 | — | — | | — |
| | 2.37 | 2.37 | — | — | 2 | 0.37 |
| 2nd increment | 2.37 | 2.37 | 4.74 | 2 | — | — |
| | 2.37 | 4.74 | — | — | — | — |
| | 2.37 | 4.74 | — | — | 4 | 0.74 |
| 3rd increment | 2.37 | 4.74 | 7.11 | 3 | — | — |
| | 2.37 | 7.11 | — | — | — | — |
| | 2.37 | 7.11 | — | — | 7 | 0.11 |

TABLE 4 is similar to TABLE 2 associated with the FIG. 3 embodiment. Computation of two output data values 18 is illustrated. The terminology d(n)=x(n)−x(n−1) is used to save space. Again gain is ignored for simplicity. The coefficient terms, $C_1$–$C_4$, are based upon $\alpha$ as described above, and change for each calculated output data point.

For each output data point, first x(m) must be calculated by holding signal 62*a* to zero and adding the antilog of the requisite number of compressed data points to the value in IR 428, just as was done in the embodiment of FIG. 3. Control signal 445 from process control block 487 causes register 422 to output a value of zero. Count value 443 is used to determine how many compressed data points will be antilogged and combined in IR 428 before output data point 18 is computed.

Next, the computation of output data point 18 is completed by sequentially combining logs of coefficients $C_1$, $C_2$, and $C_3$ with compressed data points from memory 448 and log gain 46, and adding these to the x(m) term stored in IR 428. This combination occurs in OR 438. The number of combinations in OR 438 is determined by the order of the interpolation, in this case 4.

The operations performed at times 0–5 are the same as those in TABLE 2. The d(m) terminology, e.g. d(1)=x(1)−x(0), is used to save space. The first step (performed at times 0–5) is to compute x(2) and store it in IR 428. As in TABLE 2, signal 62*a* is forced to zero while the accumulation in IR 428 is taking place. Mux 453 selects signal 429, and the input to OR 438 is disabled while this accumulation is occurring.

The time 6 step is replaced with steps 6*a*–6*g*. First, at time 6*a*, Mux 453 selects line 429 from IR 428, and x(2) is added to $C_1$*d(3) by adder 427, and the result placed in OR 438. Then, at times 6*b*–6*g*, Mux 453 selects signal 439 from OR 438 and the other coefficient terms are added to the value in OR 438, and the result placed back in OR 438 each time. At time 7, the contents of OR 438 are output as signal 18.

At times 8–11, x(4) is formed in IR 428 by accumulating antilogged compressed data points in the usual manner. Note, however, that memory 448 must go backward by three compressed data points to provide log (d(3)). In general, the address of the output data point from memory 448 moves forward by count 443 (2 for the first two data points formed below) while x(n) is being formed in IR 428. Then, the address continues forward the order of the filter minus 1 (4−1=3 in this case) while the coefficient terms are being accumulated. Finally, the address skips backward by two less than the order of the filter (4−2=2) prior to forming the next x(n) term. At times 12–14, the next output data point 18 is calculated and output.

TABLE 4

| | at 16 | at 62a | IR 428 | in OR 438 | Output 18 |
|---|---|---|---|---|---|
| 0 | — | 0 | x(0) | 0 | — |
| 1 | log(d(1)) | 0 | x(0) | | — |
| 2 | — | 0 | x(1) | | — |
| 3 | log(d(2)) | 0 | x(1) | | — |
| 4 | — | 0 | x(2) | | — |
| 5 | log(d(3)) | $\log(C_1)$ | x(2) | | — |
| 6a | — | 0 | x(2) | $x(2) + C_1*d(3)$ | — |
| 6b | log(d(4)) | $\log(C_2)$ | x(2) | | |
| 6c | | | x(2) | $x(2) + C_1*d(3) + C_2*d(4)$ | |
| 6d | log(d(5)) | log(C3) | x(2) | | |
| 6e | | | x(2) | $x(2) + C_1*d(3) + C_2*d(4) + C_3*d(5)$ | |
| 7 | | | | | $x(2) + C_1*d(3) + C_2*d(4) + C_3*d(5)$ |
| 8 | log(d(3)) | 0 | x(2) | | — |
| 9 | — | 0 | x(3) | | |
| 10 | log(d(4)) | 0 | x(3) | | |
| 11 | — | 0 | x(4) | | |
| 12 | log(d(5)) | $\log(C_1)$ | x(4) | | |
| 13a | — | | x(4) | $x(4) + C_1*d(5)$ | |
| 13b | log(d(6)) | $\log(C_2)$ | x(4) | | |
| 13c | — | | x(4) | $x(4) + C_1*d(5) + C_2*d(6)$ | |
| 13d | log(d(7)) | $\log(C_3)$ | x(4) | | — |
| 13e | — | 0 | x(4) | $x(4) + C_1*d(5) + C_2*d(6) + C_3*d(7)$ | — |
| 14 | — | 0 | x(4) | | $x(4) + C_1*d(5) + C_2*d(6) + C_3*d(7)$ |

Similarly to the FIG. 3 embodiment, assuming a constant gain, g, each term output as signal 18 is scaled by g to give terms of the form $g*x(n)+g*(C_1*d(n+1)+C_2*d(n+2)+C_3*d(n+3)$. In the more general case where gain is not constant, there are, again, small residual terms. These residuals are normally not significant for relatively slowly changing signals.

Note the importance of defining $C_0=1$. If $C_0$ were not defined as 1, it would be necessary to multiply $x(n)*C_0$, which would require a full linear multiplier which would render the invention much less efficient.

Figure 5:
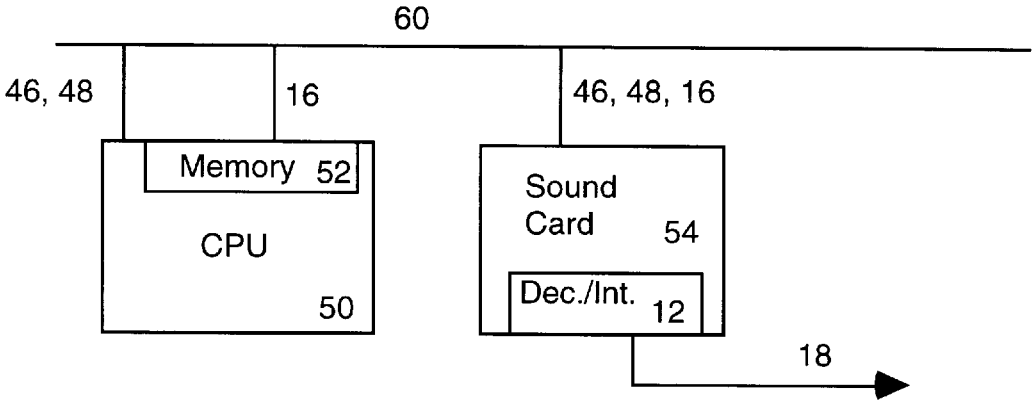
FIG. 5 shows the present invention integrated into a standard bus architecture.

FIG. 5 shows the present invention integrated into a standard bus architecture. CPU 50 serves as controller 32, providing pitch and loudness control signals 46, 48 over bus 60. CPU memory 52 may serve as memory 48, providing data 16, or the memory may be separate as shown in FIGS. 2 and 3. Decompressor/interpolator 12 is shown as part of a sound card 54, which may incorporate other signal processing functions. Output signal 18 is provided to a digital to analog converter as shown in FIG. 1.

While the exemplary preferred embodiments of the present invention are described herein with particularity, those skilled in the art will appreciate various changes, additions, and applications other than those specifically mentioned, which are within the spirit of this invention.

What is claimed is:

1. Apparatus for simultaneously decompressing and interpolating a stream of audio data points having differential log format to form a series of decompressed and interpolated output data points comprising:

means for providing a stream of differential log format compressed data points;

means for calculating a value equivalent to an audio data point before compression for each desired output data point;

means for generating an interpolation term for each desired output data point;

means for summing the value and the interpolation term to form each desired interpolated and decompressed output data point; and means for sequentially outputting each interpolated and decompressed output data point.

2. The apparatus of claim 1 wherein:

the providing means provides data points having the format log (x(n+1)−x(n)), where x(n) and x(n+1) are consecutive data points before compression;

the calculating means calculates quantities equivalent to x(n); and the generating means generates interpolation terms of the form $\alpha(x(n+1)-x(n))$, where $\alpha$ is the desired fractional distance to accomplish interpolation between data points x(n) and x(n+1);

whereby linear interpolation is accomplished simultaneously with decompression.

3. The apparatus of claim 2, wherein the calculating means includes:

an antilog means;

means for passing compressed data points log (x(n−m)−x(n−m−1)) through log (x(n)−x(n−1)) through the antilog means to get x(n−m)−x(n−m−1) through x(n)−x(n−1);

means for providing an initial condition term equivalent to x(n−m−1); and means for summing the initial condition term with x(n−m)−x(n−m−1) through x(n)−x(n−1), to form a value equivalent to x(n).

4. The apparatus of claim 3, wherein the generating means includes:

means for providing the term log $\alpha$;

means for summing the term log $\alpha$ with the compressed data point log (x(n+1)−x(n)) to get log $\alpha$+log (x(n+1)−x(n))=log ($\alpha$(x(n+1)−x(n)))

means for passing log ($\alpha$(x(n+1)−x(n))) through the antilog means to get $\alpha$(x(n+1)−x(n)).

5. The apparatus of claim 4 modified to apply a gain, further including:

means for providing terms equivalent to log (gain);

wherein the calculating means further includes means for adding the log (gain) term to log (x(n−m)−x(n−m−1)) through log (x(n)−x(n−1)); and wherein the generating means further includes means for adding the log (gain) term to the log $\alpha$+log (x(n+1)−x(n)) term.

6. The apparatus of claim 1 wherein:

the providing means provides data points having the format log (x(n+1)−x(n)), where x(n) and x(n+1) are consecutive data points before compression;

the calculating means calculates quantities equivalent to x(n); and the generating means generates interpolation terms of the form $C_1(x(n+1)-x(n))+C_2(x(n+2)-x(n+1))+\ldots+C_{N-1}*(x(n+N-1)-x(n+N-2))$, where $C_1-C_{N-1}$ are coefficients previously derived from $\alpha$, the desired fractional distance to accomplish interpolation between data points x(n) and x(n+1), said coefficients selected to accomplish polyphase interpolation of order N;

whereby polyphase interpolation is accomplished simultaneously with decompression.

7. The apparatus of claim 6, wherein the calculating means includes:

an antilog means;

means for passing compressed data points log (x(n−m)−x(n−m−1)) through log (x(n)−x(n−1)) through the antilog means to get x(n−m)−x(n−m−1) through x(n)−x(n−1);

means for providing an initial condition term equivalent to x(n−m−1); and means for summing the initial condition term with x(n−m)−x(n−m−1) through x(n)−x(n−1), to form a value equivalent to x(n).

8. The apparatus of claim 7, wherein the generating means includes:

means for providing the terms log ($C_1$) through log ($C_{N-1}$);

means for sequentially summing the terms log ($C_1$) through log ($C_{N-1}$) with sequential compressed data points log (x(p+1)−x(p)) through log (x(p+N−1)−x(p+N−2)) to get log ($C_1$)*log (x(p+1)−x(p)) through log ($C_{N-1}$)*log (x(p+N−1)−x(p+N−2))=log ($C_1$*(x(p+1)−x(p))) through log ($C_{N-1}$*(x(p+N−1)−x(p+N−2))

means for passing log ($C_1$*(x(p+1)−x(p))) through log ($C_{N-1}$*(x(p+N−1)−x(p+N−2)) through the antilog means to get ($C_1$*(x(p+1)−x(p)) through ($C_{N-1}$*(x(p+N−1)−x(p+N−2).

9. The apparatus of claim 8 modified to apply a gain, further including:

means for providing terms equivalent to log (gain);

wherein the calculating means further includes means for adding the log (gain) term to log (x(n−m)−x(n−m−1)) through log (x(n)−x(n−1)); and wherein the generating means further includes means for adding the log (gain) term to the log (x(p+1)−x(p)) through log (x(p+N−1)−x(p+N−2)) terms.

10. A method of simultaneously decompressing and interpolating a stream of audio data points having differential log format log (x(n+1)−x(n)), where x(n) and x(n+1) are consecutive data points before compression, to form a series of decompressed and interpolated output data points having the form x(n) +α(x(n+1−x(n)), where α is the desired fractional distance to accomplish interpolation between data points x(n) and x(n+1), the method comprising the steps of:

(a) providing a stream of differential log format compressed data points;

(b) calculating an x(n) term for each desired output data point;

(c) generating an interpolation term a(x(n+1)−x(n)) for each desired output data point;

(d) summing the x(n) term and the interpolation term to form each desired interpolated and decompressed output data point; and (e) sequentially outputting each interpolated and decompressed output data point.

11. The method of claim 10 wherein step (b) comprises the steps of:

(b1) antilogging a predetermined number of the compressed data points; and (b2) combining an initial term with the antilogged data points.

12. The method of claim 11, wherein step (c) includes the steps of:

(c1) providing log (α);

(c2) summing a compressed data point log (x(n+1)−x(n)) with log (α) to form log (α*(x(n+1)−x(n));

(c3) antilogging log (α*(x(n+1)−x(n)) to form α*(x(n+1)−x(n).

13. The method of claim 12, further including the step of scaling the output data points by a gain.

14. The method of claim 13, wherein the step of scaling the output data points by a gain comprises the steps of:

adding log (gain) to each compressed data term prior to step (b1); and adding log (gain) to each compressed data term prior to step (c3).

15. A method of simultaneously decompressing and interpolating a stream of audio data points having differential log format log (x(n+1)−x(n)), where x(n) and x(n+1) are consecutive data points before compression, to form a series of decompressed and interpolated output data points having the form x(n) +$C_1$*(x(n+1−x(n))+$C_2$*(x(n+2)−x(n+1))+. . . +$C_{N-1}$*(x(n+N−1), where $C_1$ through $C_{N-1}$ are coefficients based upon α, which is the desired fractional distance to accomplish interpolation between data points x(n) and x(n+1), the method comprising the steps of:

(a) providing a stream of differential log format compressed data points;

(b) calculating an x(n) term for each desired output data point;

(c) generating an interpolation term $C_1$*(x(n+1−x(n))+$C_2$*(x(n+2)−x(n+1))+ . . . +$C_{N-1}$*(x(n+N−1)−x(n+N−2)) for each desired output data point;

(d) summing the x(n) term and the interpolation term to form each desired interpolated and decompressed output data point; and (e) sequentially outputting each interpolated and decompressed output data point.

16. The method of claim 15 wherein step (b) comprises the steps of:

(b1) antilogging a predetermined number of the compressed data points; and (b2) combining a predetermined initial term with the antilogged data points.

17. The method of claim 16, wherein step (c) includes the steps of:

(c1) providing log ($C_1$) through log ($C_{N-1}$);

(c2) sequentially summing compressed data points log (x(n+1)−x(n)) through log ((x(n+N−1)−x(n+N−2)) with log ($C_1$) through log ($C_{N-1}$) to form log ($C_1$*(x(n+1−x(n))+ . . . +$C_{N-1}$*(x(n+N−1)−x(n+N−2))); and (c3) antilogging log ($C_1$*(x(n+1−x(n))+ . . . +$C_{N-1}$*(x(n+N−1)−x(n+N−2))) to form $C_1$*(x(n+1−x(n))+ . . . +$C_{N-1}$*(x(n+N−1)−x(n+N−2)).

18. The method of claim 17, further including the step of scaling the output data points by a gain.

19. The method of claim 18, wherein the step of scaling the output data points by a gain comprises the steps of:

adding log (gain) to each compressed data term prior to step (b1); and adding log (gain) to each compressed data term prior to step (c3).

* * * * *

UNITED STATES PATENT AND TRADEMARK OFFICE

CERTIFICATE OF CORRECTION

PATENT NO. : 5,890,126

DATED : March 30, 1999

INVENTOR(S) : Lindemann

It is certified that error appears in the above-identified patent and that said Letters Patent is hereby corrected as shown below:

Column 1, line 23, delete "analogsystem" and insert --analog system--.

Column 2, line 42, delete "($C_{N-}$1)" and insert --($C_{N-1}$)--.

Column 3, line 36, after 'close' insert -- to--.

Column 6, lines 2-3, delete "( x(n+1)" and insert --(x(n+1)--.

Column 8, line 55, delete "a" and insert --$\alpha$--.

Column 10, line 22, after 'referred to' insert -- as --.

Column 11, line 8, after 'assume' insert -- that --.

Column 12, line 32, delete "then" and insert --than--.

Column 17, line 28, after 'x(p+N-2))' insert --; and--.

Signed and Sealed this

Seventh Day of December, 1999

*Attest:*

Q. TODD DICKINSON

*Attesting Officer*

*Acting Commissioner of Patents and Trademarks*